US010673175B2

(12) United States Patent
Matsumoto et al.

(10) Patent No.: US 10,673,175 B2
(45) Date of Patent: Jun. 2, 2020

(54) ELECTRICAL CONNECTOR ASSEMBLY WITH A DRAINAGE STRUCTURE

(71) Applicants: Tyco Electronics Japan G.K., Kanagawa-ken (JP); TOYOTA JIDOSHA KABUSHIKI KAISHA, Aichi-ken (JP)

(72) Inventors: Tsugumi Matsumoto, Kanagawa (JP); Katsuhiro Kato, Kanagawa (JP); Tomoyuki Funayama, Aichi-ken (JP)

(73) Assignees: Tyco Electronics Japan G.K., Kanagawa (JP); Toyota Jidosha Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 16/019,800

(22) Filed: Jun. 27, 2018

(65) Prior Publication Data

US 2019/0006786 A1 Jan. 3, 2019

(30) Foreign Application Priority Data

Jun. 29, 2017 (JP) ..... 2017-127022

(51) Int. Cl.
*H01R 13/52* (2006.01)
*H01R 12/71* (2011.01)
(Continued)

(52) U.S. Cl.
CPC ..... *H01R 13/52* (2013.01); *H01R 12/716* (2013.01); *H01R 13/5219* (2013.01);
(Continued)

(58) Field of Classification Search
CPC .. H01R 13/52; H01R 12/716; H01R 13/5227; H01R 13/5219; H01R 25/006; H01R 13/6273; H01R 12/724; H01R 13/743
(Continued)

(56) References Cited

U.S. PATENT DOCUMENTS 9,356,385 B2 * 5/2016 Kobayashi ..... H01R 13/5202
9,531,115 B2 * 12/2016 Ebihara ..... H01R 13/5227
(Continued)

FOREIGN PATENT DOCUMENTS

CN 102460874 A 5/2012
CN 103369893 A 10/2013
(Continued)

OTHER PUBLICATIONS

Extended European Search Report, European Patent Application No. 18179706.9, dated Nov. 14, 2018, 9 pages.
(Continued)

*Primary Examiner* — Travis S Chambers
(74) *Attorney, Agent, or Firm* — Barley Snyder

(57) ABSTRACT

An electrical connector assembly comprises a first connector including a first housing having a mating opening, a second connector including a second housing configured to be mated with the mating opening of the first connector, and a drainage structure provided on and corresponding to a boundary portion between the first housing and the second housing. The boundary portion faces the mating opening. The drainage structure includes a convex region having a top at the boundary portion, a first concave region continuous with the convex region and formed in the first housing, and a second concave region continuous with the convex region and formed in the second housing.

20 Claims, 8 Drawing Sheets

(51) Int. Cl.

| | |
|---|---|
| *H01R 13/74* | (2006.01) |
| *H01R 12/72* | (2011.01) |
| *H01R 13/627* | (2006.01) |
| *H01R 25/00* | (2006.01) |

(52) U.S. Cl.
CPC ..... *H01R 13/5227* (2013.01); *H01R 12/724* (2013.01); *H01R 13/6273* (2013.01); *H01R 13/743* (2013.01); *H01R 25/006* (2013.01)

(58) Field of Classification Search
USPC ..... 439/519, 190, 205, 206
See application file for complete search history.

(56) References Cited

U.S. PATENT DOCUMENTS

| | | | |
|---|---|---|---|
| 2009/0149052 | A1 | 6/2009 | Ito et al. |
| 2012/0091154 | A1 | 4/2012 | Satoh et al. |
| 2013/0265728 | A1 | 10/2013 | Sakai |
| 2014/0099811 | A1 | 4/2014 | Chiu |
| 2017/0373480 | A1* | 12/2017 | Matsumoto ..... H01R 13/6395 |

FOREIGN PATENT DOCUMENTS

| | | | |
|---|---|---|---|
| JP | 8212874 | A | 8/1996 |
| JP | 2005-166347 | A | 6/2005 |
| JP | 2012-195164 | A | 10/2012 |
| JP | 201560708 | A | 3/2015 |
| TW | M456609 | U | 7/2013 |
| WO | 2013042714 | A1 | 3/2013 |

OTHER PUBLICATIONS

Ohinese Office Action, Chinese Patent Application No. 201810661392.4, dated Jul. 24, 2019, 8 pages.
Abstract and English machine translation of JP 2005-166347 A, dated Jun. 23, 2005, 17 pages.
Abstract and English machine translation of JP 2012-195164 A, dated Oct. 11, 2012, 15 pages.

* cited by examiner

FIG. 7A
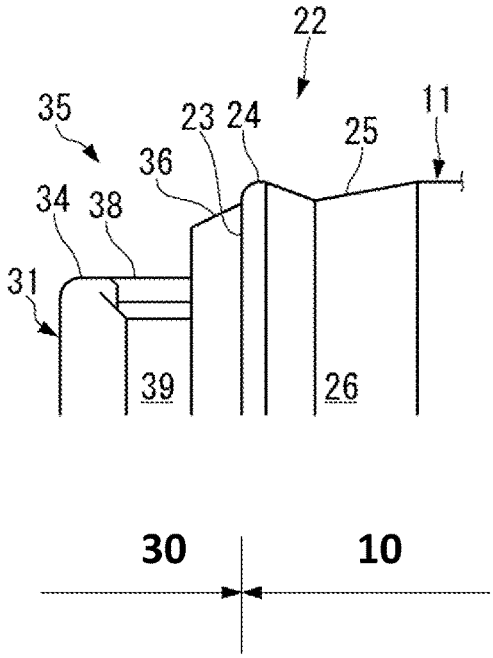
FIG. 7B
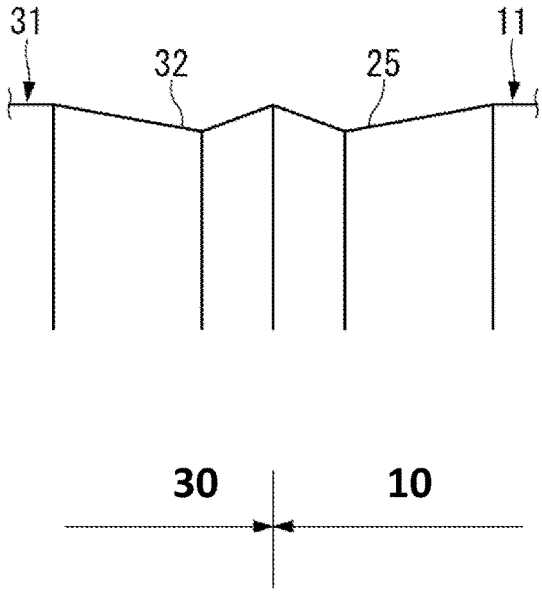
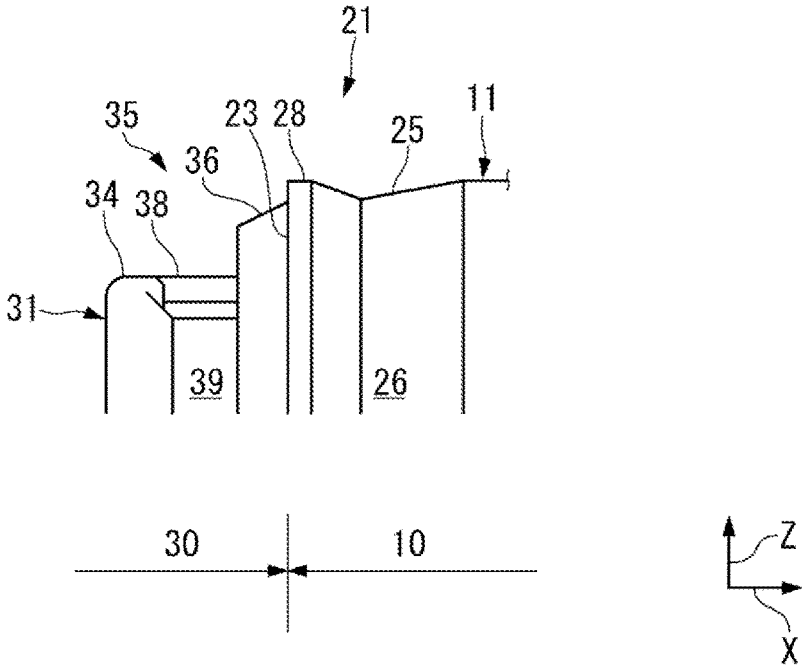
FIG. 7C

ELECTRICAL CONNECTOR ASSEMBLY WITH A DRAINAGE STRUCTURE

CROSS-REFERENCE TO RELATED APPLICATION

This application claims the benefit of the filing date under 35 U.S.C. § 119(a)-(d) of Japanese Patent Application No. 2017-127022, filed on Jun. 29, 2017.

FIELD OF THE INVENTION

The present invention relates to an electrical connector assembly and, more particularly, to an electrical connector assembly that suppresses entry of water into the electrical connector assembly through a boundary portion between a pair of electrical connectors.

BACKGROUND

In an electrical connector assembly, to prevent water from entering the electrical connector assembly, a rubber seal ring that is separate from a housing is interposed between a pair of electrical connectors, that is, between a male connector and a female connector mated with each other. In general, water falls onto an upper surface of the electrical connector assembly in the vertical direction. Accordingly, there is a high probability of the water received on the upper surface entering a gap between the male connector and the female connector. The seal ring allows the electrical connector assembly to be waterproof but requires the provision of an additional part in forming the electrical connector assembly. Alternatively, in applications in which the electrical connector assembly is placed at a position less likely to be exposed to water, it is possible to ensure a certain level of waterproof performance, or a moderate waterproof performance, without providing a seal ring.

International Patent Application Publication No. WO 2013/042714 proposes an electronic circuit device for airbag deployment that reliably drains water to a recessed portion formed in a casing, regardless of the position where liquid drops onto the electronic circuit device or the angle at which the electronic circuit device is attached to a vehicle. The electronic circuit device has an enlarged diameter portion 12*c* formed across the entire area in the circumferential direction of one side surface 12*b* of a casing 12, excluding a bottom portion 12*a*. The enlarged diameter portion 12*c* has an opening gradually expanding toward the outside of an opening end surface. The electronic circuit device has a recessed portion 12*e* formed between the one side surface 12*b* of the casing 12 and the other side surface 12*d* of the casing 12 disposed on a side opposite to the one side surface 12*b*. The recessed portion 12*e* forms a drainage groove, and has inclined surfaces which are inclined toward the bottom portion 12*a*.

The electronic circuit device disclosed in WO 2013/042714 has the enlarged diameter portion 12*c* formed across the entire area in the circumferential direction excluding the bottom portion 12*a*, and the electronic circuit device consequently cannot be formed in a compact manner. Further, although the electronic circuit device disclosed in WO 2013/042714 is provided with a connector 13, a main portion of the connector 13 is accommodated in an accommodating chamber; it is not assumed that water falls onto a boundary portion between a pair of connectors.

SUMMARY

An electrical connector assembly comprises a first connector including a first housing having a mating opening, a second connector including a second housing configured to be mated with the mating opening of the first connector, and a drainage structure provided on and corresponding to a boundary portion between the first housing and the second housing. The boundary portion faces the mating opening. The drainage structure includes a convex region having a top at the boundary portion, a first concave region continuous with the convex region and formed in the first housing, and a second concave region continuous with the convex region and formed in the second housing.

BRIEF DESCRIPTION OF THE DRAWINGS

The invention will now be described by way of example with reference to the accompanying Figures, of which:

FIG. 7A is a schematic view of an embodiment of the boundary portion;

FIG. 7B is a schematic view of another embodiment of the boundary portion;

FIG. 7C is a schematic view of another embodiment of the boundary portion;

DETAILED DESCRIPTION OF THE EMBODIMENT(S)

Figure 1:
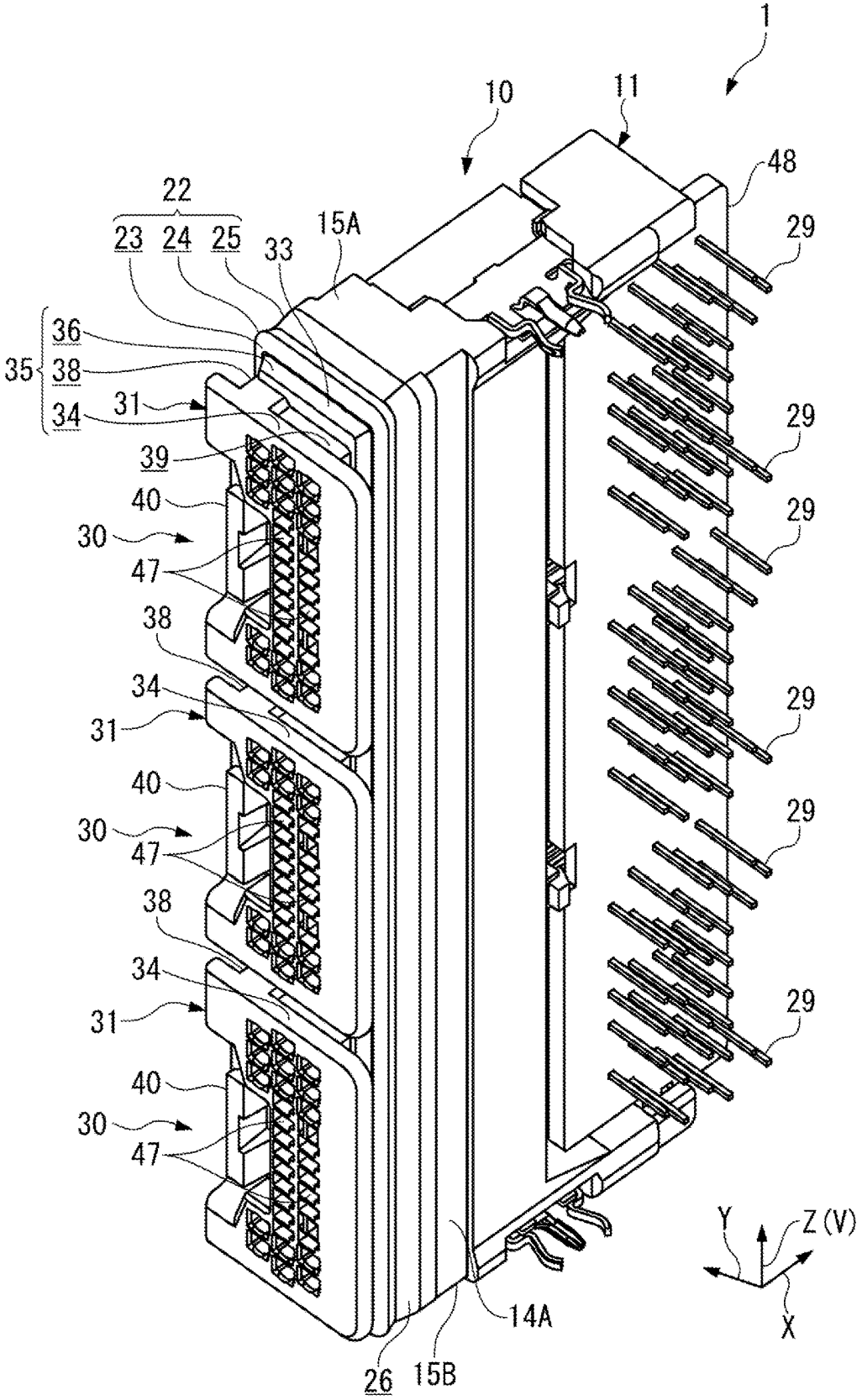
FIG. 1 is a top right perspective view of an electrical connector assembly according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

An electrical connector assembly 1 according to an embodiment is shown in FIGS. 1, 2, 4, 5A, and 5B. The electrical connector assembly 1 includes a male connector 10 and a plurality of female connectors 30. The male connector 10 is fixed to a printed wiring board and the female connectors 30 are mated with the male connector 10.

In this embodiment, the male connector 10 is mated with three female connectors 30 which are aligned in one direction. In other embodiments, the number of female connectors 30 to be mated with the male connector 10 may vary in various applications. In each of the male connector 10 and the female connector 30, a side where the male connector 10 and the female connector 30 are mated is defined as a front side and a side opposite to the front side is defined as a rear side.

Figure 2:
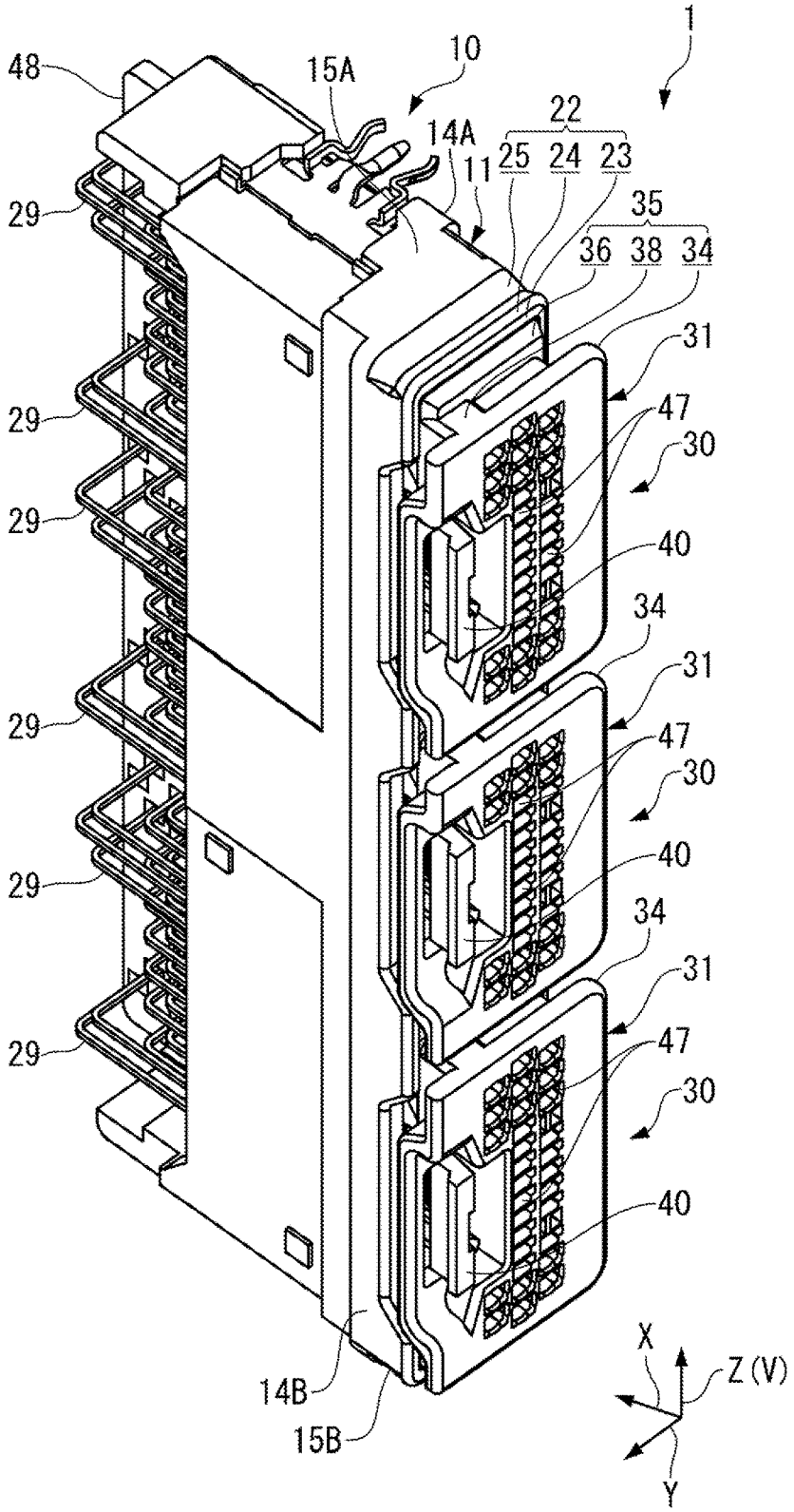
FIG. 2 is a top left perspective view of the electrical connector assembly.
Figure 3:
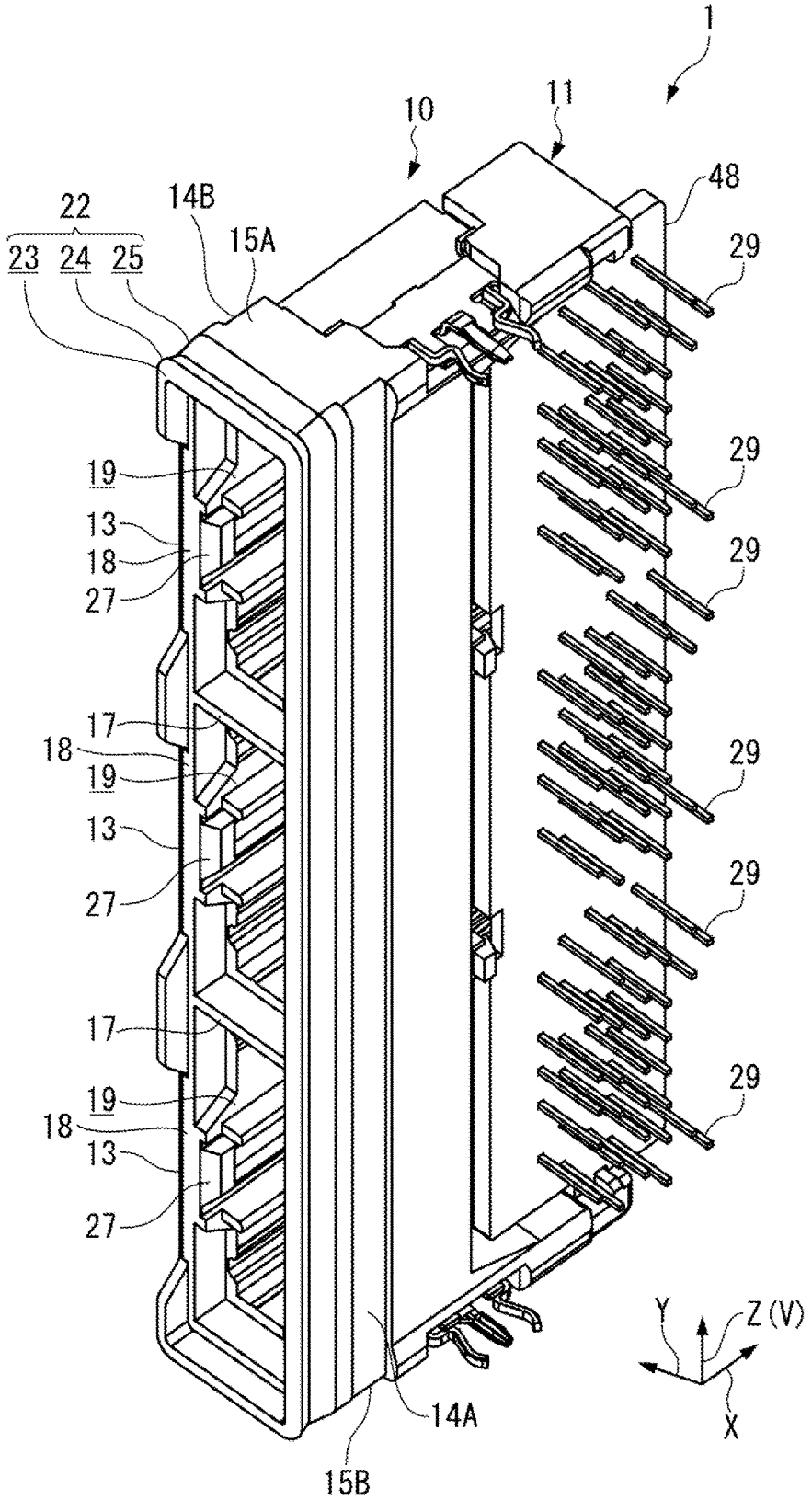
FIG. 3 is a perspective view of a male connector of the electrical connector assembly.

As shown in FIGS. 1-3, the electrical connector assembly 1 is used in an attitude where a height direction Z matches a vertical direction V. Accordingly, an upper surface of the electrical connector assembly 1 is a water receiving portion onto which water is likely to fall. In the electrical connector assembly 1, a depth direction X, a width direction Y and the height direction Z are defined by arrows as shown in FIG. 1. The same advantageous effect described below can be acquired even if the electrical connector assembly 1 of this embodiment is disposed in such a manner that the width direction Y matches the vertical direction.

The male connector 10, as shown in FIGS. 1-3, includes a first housing 11 and a plurality of male contacts 29. In an embodiment, the first housing 11 is integrally formed of a resin having an electrical insulation. The contacts 29 are formed of a material having conductivity, such as a copper-based material. The material of the male connector 10 is the same as that of the female connectors 30.

The first housing 11, as shown in FIGS. 1-3, holds the plurality of contacts 29 in a state where the contacts 29 are aligned at intervals. A hood 13 configured to be mated with the female connectors 30 is formed on the first housing 11 as shown in FIG. 3. The contacts 29 are arranged at desired positions by a tine plate 48 attached to the first housing 11.

The hood 13 is a rectangular cylindrical member, and has mating openings 18. The hood 13 has receiving cavities 19 that receive the female connectors 30. In this embodiment, the hood 13 is partitioned into three hoods by partition walls 17, and the female connectors 30 are mated with respective receiving cavities 19 corresponding to these three hoods 13.

A first part of each of the male contacts 29 that is configured to be electrically connected to a female contact of the female connector 30 extends to the inside of the receiving cavity 19. A second part of each of the contacts 29 that is configured to be connected to a printed wiring board extends to an area behind the first housing 11. In the receiving cavity 19, the contacts 29 are disposed in a plurality of rows in the width direction Y and are disposed in a plurality of columns in the height direction Z.

As shown in FIGS. 1-5B, the first housing 11 has a right side surface 14A, a left side surface 14B, an upper surface 15A, and a lower surface 15B. The right side surface 14A and the left side surface 14B extend in the height direction Z and are opposed to each other at a predetermined interval in the width direction Y. The upper surface 15A and the lower surface 15B respectively connect both ends of each of the right side surface 14A and the left side surface 14B in the height direction Z. As shown in FIG. 3, two partition walls 17 partition the first housing 11 into three parts along the height direction Z so that three hoods 13 are formed.

As shown in FIG. 3, in the hood 13, lock projections 27 are provided on a side surface of a front end portion of the left side surface 14B which faces the receiving cavities 19. The lock projections formed on lock arms 40 of the female connectors 30 described later are locked to the lock projections 27. In the process of mating the male connector 10 with the female connectors 30, the lock projections of the lock arms 40 move over the lock projections 27 of the male connector 10 to engage in a locking position. Accordingly, the male connector 10 and the female connectors 30 are locked to each other.

As shown in FIGS. 1-5B, the first housing 11 has a first drainage structure 22 which is formed so as to project from a front end of the hood 13. The first drainage structure 22 is provided for suppressing entry of water which falls onto a boundary portion between the male connector 10 and the female connector 30 from above, into the male connector 10 and the female connector 30. The first drainage structure 22 is provided on and corresponding to the upper surface 15A, the right side surface 14A, and the lower surface 15B. The first drainage structure 22 guides water which falls onto the upper surface 15A forming the water receiving portion, from the upper surface 15A along the right side surface 14A so as to discharge the water. The right side surface 14A is a side surface of the first housing 11 distinct from the water receiving portion.

The first drainage structure 22, as shown in FIGS. 1-5B, has a front end surface 23, an inclined surface 24, and a recessed groove 25. The front end surface 23 is formed of a flat surface which is orthogonal to the depth direction X. The inclined surface 24 communicates with the front end surface 23. The recessed groove 25 communicates with the inclined surface 24, and has a V-shape. In another embodiment, the recessed groove 25 may have a U-shape.

Figure 6A:
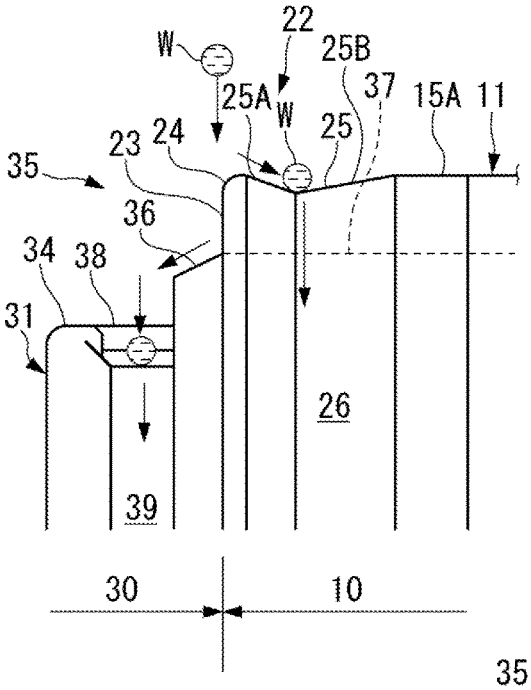
FIG. 6A is a schematic view of a boundary portion of the electrical connector assembly with water contacting a first position on the boundary portion.

As shown in FIG. 6A, the inclined surface 24 is inclined from the front toward the rear so as to bulge toward the outside of the first housing 11 from the front end surface 23. On the upper surface 15A, a rear end of the inclined surface 24 is disposed at a position higher than the front end surface 23. As shown in FIG. 6A, the recessed groove 25 has a first inclined surface 25A and a second inclined surface 25B. The first inclined surface 25A is inclined toward the inside of the first housing 11 from the front toward the rear. The second inclined surface 25B is inclined toward the outside of the first housing 11 from the first inclined surface 25A. A rear end of the second inclined surface 25B communicates with the upper surface 15A.

The first drainage structure 22 has, on the upper surface 15A as shown in FIG. 6A, an undulation where the inclined surface 24 continuously increases in height toward the rear and, with an apex of the inclined surface 24 used as a boundary, the first inclined surface 25A of the recessed groove 25 continuously decreases in height toward the rear and, the second inclined surface 25B then continuously increases in height toward the rear. In other words, in the first drainage structure 22, a convex region is formed of the inclined surface 24 and the first inclined surface 25A, and a concave region is formed of the first inclined surface 25A and the second inclined surface 25B.

Figure 4:
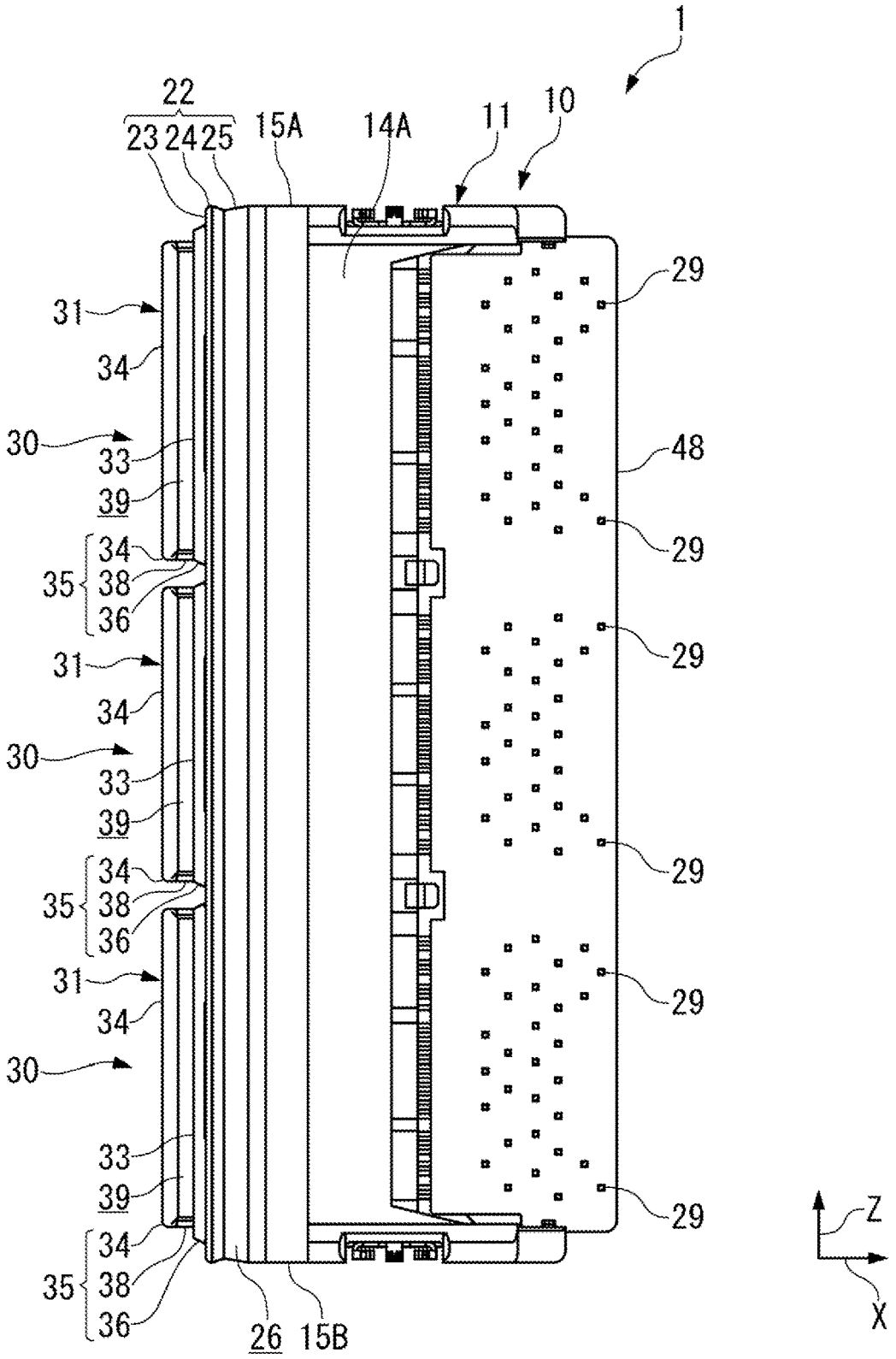
FIG. 4 is a right side view of the electrical connector assembly.
Figure 5A:
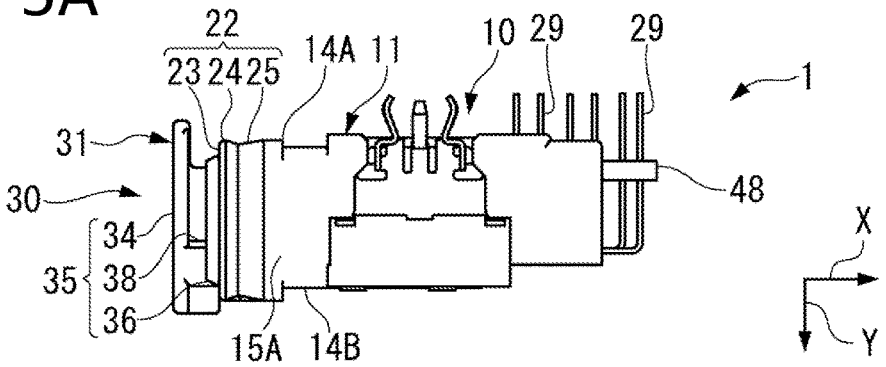
FIG. 5A is a bottom view of the electrical connector assembly.
Figure 5B:
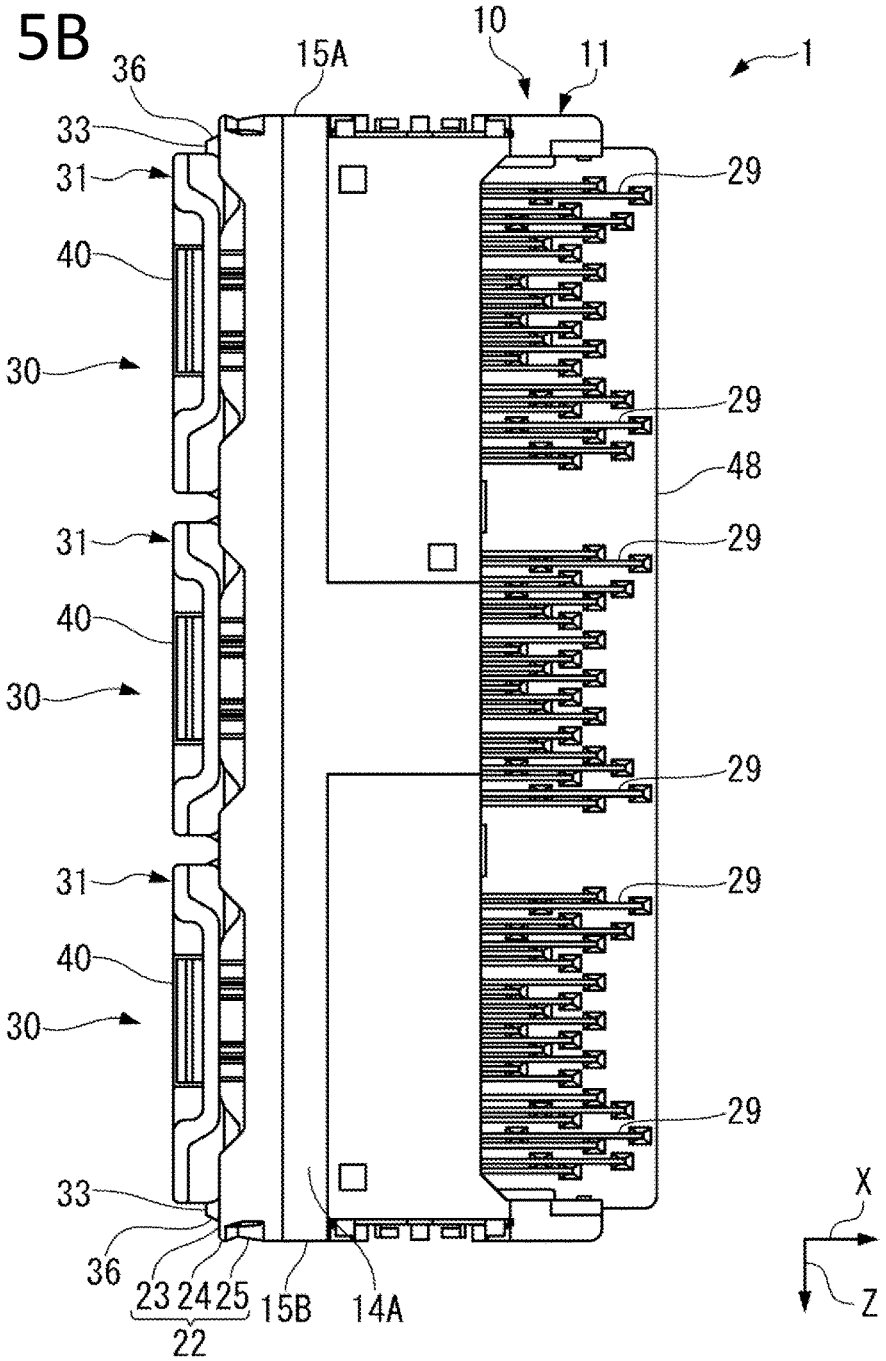
FIG. 5B is a left side view of the electrical connector assembly.

In this embodiment, the first drainage structure 22 has been described with respect to the upper surface 15A forming the water receiving portion. However, by inverting the male connector 10, the lower surface 15B in FIG. 1 forms the water receiving portion; as shown in FIG. 5B, the first drainage structure 22 is also provided on the lower surface 15B. Accordingly, even if the male connector 10 is inverted from a state shown in FIG. 1, the first drainage structure 22 can function. The female connector 30 is also provided with a second drainage structure 35 so as to handle vertical inversion. In the same manner, as shown in FIGS. 1 and 4, the first drainage structure 22 is provided to the entire area of the right side surface 14A in the height direction Z and hence, even if the electrical connector assembly 1 is used in an attitude where the right side surface 14A of the male connector 10 faces upward, the first drainage structure 22 can function.

As shown in FIGS. 1, 2, 4, 5A and 5B, each female connector 30 includes a second housing 31 and a plurality of female contacts held by the second housing 31. The second housing 31 holds a number of female contacts corresponding to the number of male contacts 29, which are held by the male connector 10, at positions corresponding to those of the male contacts 29.

Each second housing 31, as shown in FIGS. 1, 2, 4, 5A, and 5B, includes a mating block 33, a rear end wall 34, and a lock arm 40. The mating block 33 is provided on the front side. The rear end wall 34 is provided on the rear side. The lock arm 40 locks the female connector 30 and the male connector 10 to each other. In the second housing 31, a plurality of contact accommodating holes 47 are formed in a grid pattern, and the female contacts are inserted into the respective contact accommodating holes 47. The contact accommodating holes 47 penetrate through the second housing 31 in a front-rear direction.

Figure 6B:
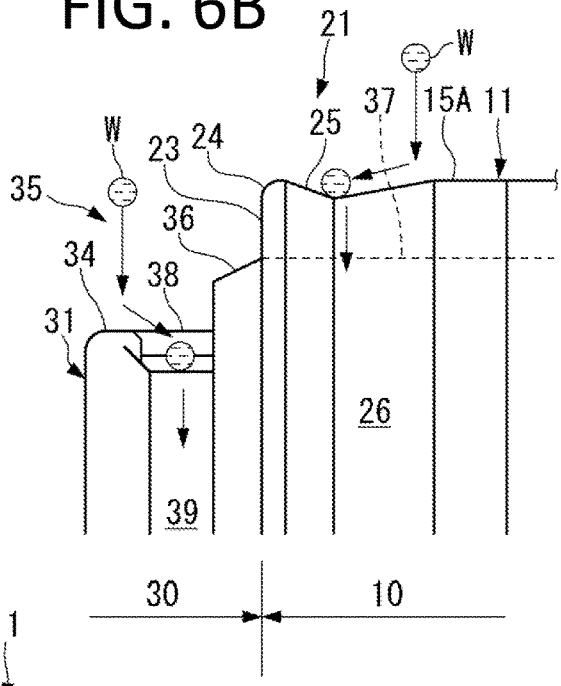
FIG. 6B is a schematic view of the boundary portion with water contacting a second position on the boundary portion.
Figure 6C:
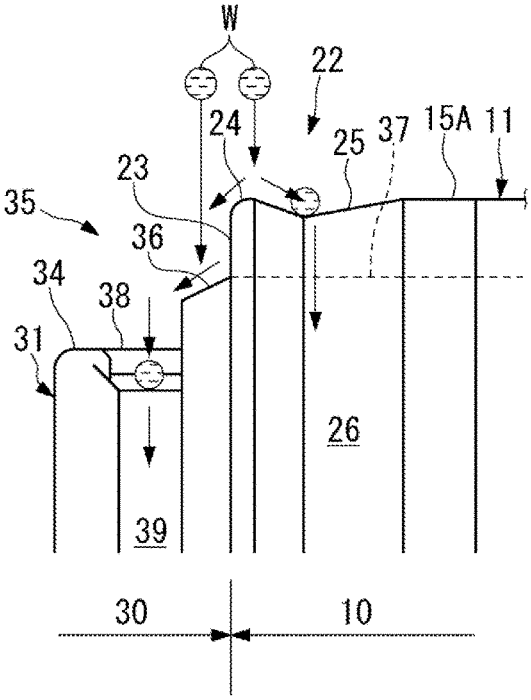
FIG. 6C is a schematic view of the boundary portion with water contacting a third position on the boundary portion.
Figure 6C:
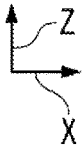

A front side of each mating block 33 is inserted into the receiving cavity 19 of the first housing 11. Each mating block 33 has an inclined surface 36 and a flat surface 37 as shown in FIGS. 6A-6C. The inclined surface 36 is inclined such that an outer periphery of the inclined surface 36 bulges toward the outside of the second housing 31 from the rear toward the front. The flat surface 37 is parallel to the depth direction X. The flat surface 37 of the mating block 33 is inserted into the receiving cavity 19.

The rear end wall 34 is formed so as to project in a flange shape toward the outside in the circumferential direction, as shown in FIGS. 6A-6C. Accordingly, a portion between the mating block 33 and the rear end wall 34 is recessed compared to the mating block 33 and the rear end wall 34. A stop wall 38 is provided at the portion recessed between the mating block 33 and the rear end wall 34.

The second housing 31 has the second drainage structure 35, as shown in FIGS. 1, 2, 4, 5A, and 6A-6C. The second drainage structure 35 comprises the rear end wall 34, the inclined surface 36 of the mating block 33, and the stop wall 38. As described above, the portion between the rear end wall 34 and the inclined surface 36 is recessed, and the recess comprises a second drainage path 39. On an upper surface of the second housing 31, one side of the second drainage path 39 in the width direction Y is blocked by the stop wall 38.

As shown in FIG. 4, the second drainage structure 35 is continuous from the upper surface to a lower surface of the second housing 31 through a side surface of the second housing 31. The stop wall 38 is also provided to the lower surface of the second housing 31. The second drainage path 39 is provided over a range from the stop wall 38 on the upper surface to the stop wall 38 on the lower surface. Accordingly, water introduced into the second drainage path 39 on the upper surface of the second housing 31 is guided by the second drainage path 39 so as to flow toward the lower surface.

As shown in FIG. 6A, when the male connector 10 and the female connector 30 are mated with each other, the mating block 33 of the second housing 31 is inserted into the receiving cavity 19 of the first housing 11, and the inclined surface 36 of the second housing 31 is exposed to the outside of the first housing 11.

The first drainage structure 22 and the second drainage structures 35 together form the drainage structure of the electrical connector assembly 1. The drainage structure comprises a convex region having a top at the boundary portion between the male connector 10 and the female connector 30. The convex region has an undulation where the convex region ascends on the first inclined surface 25A of the first drainage structure 22, a portion where the first inclined surface 25A and the inclined surface 24 are connected with each other forms the top of the convex region, and the convex region passes through the mating opening 18, and descends on the inclined surface 36 of the second drainage structure 35.

In the first drainage structure 22, the first inclined surface 25A and the second inclined surface 25B which form a V-shape comprise a first concave region. In the second drainage structure 35, the portion which is recessed between the mating block 33 and the rear end wall 34 comprises a second concave region.

The second drainage structure 35 of the female connector 30 is disposed at a position lower than the first drainage structure 22 of the male connector 10 in the height direction Z, as shown in FIGS. 6A-6C. The inclined surface 36 descends toward the rear of the female connector 30 from the front end surface 23 of the first drainage structure 22. The second drainage path 39 is continuous with a surface extending from the inclined surface 36 along the height direction Z. The second drainage path 39 is disposed at a position still lower than the inclined surface 36.

The manner of operation of the electrical connector assembly 1 will now be described with reference to FIG. 6A-6C.

First, the movement of water W when the water W falls onto the boundary portion between the male connector 10 and the female connector 30 will be described with reference to FIG. 6A. In the first drainage structure 22, water W falls onto the inclined surface 24 of the first drainage structure 22 which is disposed at a high position. Then, a portion of the water W flows toward the first housing 11 of the male connector 10, and another portion of the water W flows toward the second housing 31 of the female connector 30.

The water W flowing toward the first housing 11 flows from the top formed of the inclined surface 24 and the first inclined surface 25A to a bottom of the recessed groove 25. The water W which reaches the bottom of the recessed groove 25 flows downward along a first drainage path 26 formed of the recessed groove 25 on the right side surface 14A. The water W flowing toward the second housing 31 is guided by the inclined surface 36 and reaches the second drainage path 39, and then flows downward along the second drainage path 39.

In the electrical connector assembly 1, water W which falls onto the boundary portion between the male connector 10 and the female connector 30 thus branches into water toward the first housing 11 and water toward the second housing 31. After the water W branches, downward flows are generated due to the effect of convex regions formed of the first inclined surface 25A and the inclined surface 36. Therefore, in the electrical connector assembly 1, at the boundary portion between the male connector 10 and the female connector 30, there is a low probability of water W stagnating at a portion in the vicinity of the mating opening 18 of the first housing 11 where water would be most likely to enter the electrical connector assembly 1. Accordingly, entry of water W into the electrical connector assembly 1 can be suppressed.

Further, the electrical connector assembly 1 has the convex region and the concave region, and these regions can be formed of an undulation of the first housing 11 and the second housing 31. Accordingly, it is unnecessary to increase sizes of the first housing 11 and the second housing 31. Therefore, a compact electrical connector assembly 1 can be obtained.

In the electrical connector assembly 1, the first drainage path 26 of the first drainage structure 22 is continuous with a lower end of the first housing 11. The second drainage paths 39 of the second drainage structures 35 are also continuous with a lower end of the second housing 31. With such a configuration, water W is discharged without stagnating in either of the first drainage structure 22 or the second drainage structure 35, suppressing entry of water W into the electrical connector assembly 1.

A portion onto which water W falls is not limited to the boundary between the male connector 10 and the female connector 30. As shown in FIG. 6B, there may be a case where water W falls onto a portion which is away from the boundary. Water W which falls onto the first housing 11 is guided by the first drainage path 26 formed of the recessed groove 25 and flows toward the lower end along the first drainage path 26. Further, water W which falls onto the second housing 31 is guided by the second drainage path 39, and flows toward the lower end along the second drainage path 39. Accordingly, there is a low probability of water W reaching an area in the vicinity of the mating opening 18 of the first housing 11, suppressing entry of water W into the electrical connector assembly 1.

As shown in FIG. 6C, there may also be a case where water W falls on both the first housing 11 and the second housing 31. The water W which falls onto the first housing 11 and the second housing 31 is respectively guided to the first drainage path 26 of the first drainage structure 22 and the second drainage path 39 of the second drainage structure 35. Accordingly, there is a low probability of water W reaching an area in the vicinity of the mating opening 18 of the first housing 11, suppressing entry of water W into the electrical connector assembly 1.

In the electrical connector assembly 1 embodiment described above, the male connector 10 and the female connector 30 differ from each other in position in the height direction Z at the boundary portion between the male connector 10 and the female connector 30. In another embodiment, as shown in FIG. 7A, the male connector 10 and the female connector 30 may have an approximately equal height at the boundary portion between the male connector 10 and the female connector 30.

In the electrical connector assembly 1 embodiment described above, with increasing distance from the boundary portion between the male connector 10 and the female connector 30, the male connector 10 increases in height along the inclined surface 24, and the male connector 10 then decreases in height along the first inclined surface 25A. In another embodiment shown in FIG. 7B, the recessed groove 25 and a recessed groove 32 may be formed such that the male connector 10 only decreases in height with increasing distance from the boundary.

In the electrical connector assembly 1 embodiment described above, the inclined surface faces the boundary between the male connector 10 and the female connector 30. In another embodiment shown in FIG. 7C, the recessed groove 25 may be formed such that an outer peripheral surface 28 extending parallel to a mating direction is interposed between the male connector 10 and the female connector 30. If the size in the mating direction of the outer peripheral surface 28 extending parallel to the mating direction is greater than the size of a falling drop of water, it becomes difficult to introduce the drop of water into the drainage groove. Accordingly, it is necessary to set the size in the mating direction of the outer peripheral surface 28 smaller than that of a drop of water.

Figure 8A:
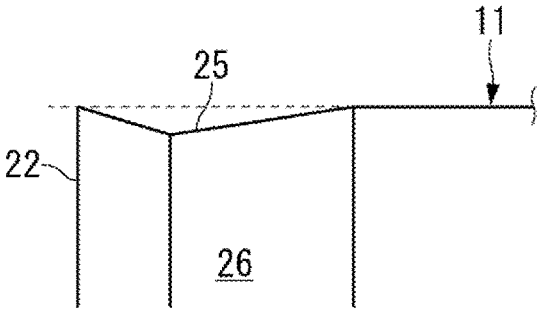
FIG. 8A is a schematic view of an embodiment of a recessed groove of the boundary portion.
Figure 8B:
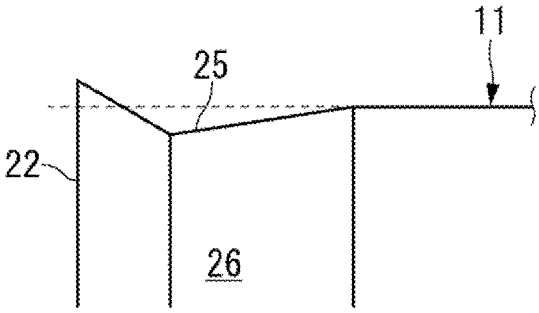
FIG. 8B is a schematic view of another embodiment of the recessed groove.

In the electrical connector assembly 1, both edges of the recessed groove 25 may have a same height in the depth direction X, as shown in FIG. 8A, or the front side of the recessed groove 25 may be set higher than the rear side of the recessed groove 25, as shown in FIG. 8B.

Figure 8C:
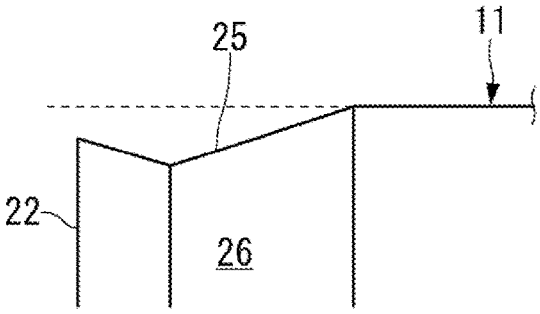
FIG. 8C is a schematic view of another embodiment of the recessed groove.

Alternatively, as shown in FIG. 8C, the rear side of the recessed groove 25 may be set higher than the front side of the recessed groove 25.

Figure 8D:
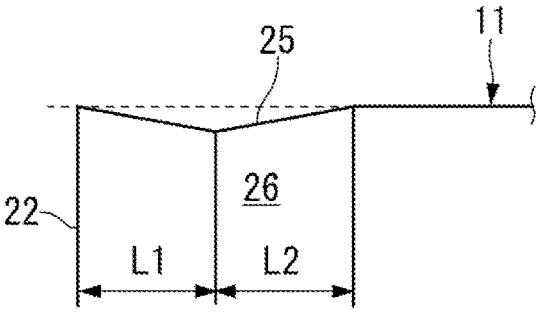
FIG. 8D is a schematic view of another embodiment of the recessed groove.
Figure 8D:
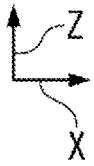

In the electrical connector assembly 1 embodiment described above, a portion of the recessed groove 25 on the forward side of a peak of the concave has a shorter length than a portion of the recessed groove 25 on the rearward side of the peak of the concave. In another embodiment, the portion of the recessed groove 25 on the forward side of the peak of the concave may have a greater length than the portion of the recessed groove 25 on the rearward side of the peak of the concave. Alternatively, in the embodiment shown in FIG. 8D, a length L1 of the portion of the recessed groove 25 on the forward side of the peak of the concave may be set equal to a length L2 of the portion of the recessed groove 25 on the rearward side of the peak of the concave.

What is claimed is:

1. An electrical connector assembly, comprising:

a first connector including a first housing having a mating opening;

a second connector including a second housing mated with the first connector through the mating opening; and a drainage structure provided on and corresponding to a boundary portion including a portion of the first housing adjacent the mating opening and a portion of the second housing adjacent the mating opening with the second housing mated with the first housing, the drainage structure including:

a convex region formed in the first housing or the second housing;

a first concave region continuous with the convex region and formed in the first housing; and a second concave region continuous with the convex region and formed in the second housing.

2. The electrical connector assembly of claim 1, wherein the convex region, the first concave region, and the second concave region are disposed at a plurality of water receiving portions onto which water is likely to fall in the first housing and the second housing.

3. The electrical connector assembly of claim 2, further comprising a first drainage path where water is guided on a side surface of the first housing, the first drainage path is continuous with the first concave region and is distinct from the water receiving portion of the first housing.

4. The electrical connector assembly of claim 3, further comprising a second drainage path where water is guided on a side surface of the second housing, the second drainage path is continuous with the second concave region and is distinct from the water receiving portion of the second housing.

5. The electrical connector assembly of claim 1, wherein the convex region has a first inclined surface formed on the first housing and descending toward a rear of the first housing.

6. The electrical connector assembly of claim 5, wherein the convex region has a second inclined surface formed on the second housing and descending toward a rear of the second housing.

7. The electrical connector assembly of claim 6, wherein the first inclined surface and the second inclined surface are aligned with each other in a height direction.

8. The electrical connector assembly of claim 6, wherein the first inclined surface and the second inclined surface are offset from each other in a height direction.

9. An electrical connector assembly, comprising:

a first connector including a first housing having a mating opening;

a second connector including a second housing mated with the first connector through the mating opening; and a drainage structure provided on and corresponding to a boundary portion including a portion of the first housing adjacent the mating opening and a portion of the second housing adjacent the mating opening with the second housing mated with the first housing, the drainage structure including:

a first drainage structure formed on the first housing including a convex region and a first concave region continuous with the convex region; and a second drainage structure formed on the second housing including a second concave region disposed adjacent to and continuous with the convex region of the first housing.

10. The electrical connector assembly of claim 9, wherein the first drainage structure projects from a front end of a hood of the first housing surrounding the mating opening.

11. The electrical connector assembly of claim 9, wherein the first drainage structure includes a flat front end surface, a first inclined surface extending from the flat front end surface toward an outside of the first housing, and a recessed groove extending from the first inclined surface.

12. The electrical connector assembly of claim 11, wherein the flat front end surface extends in a direction orthogonal to a depth direction of the first housing.

13. The electrical connector assembly of claim 11, wherein the convex region is formed at an intersection of the first inclined surface and the recessed groove.

14. The electrical connector assembly of claim 13, wherein the recessed groove has a V-shape or a U-shape and forms the first concave region.

15. The electrical connector assembly of claim 14, wherein a bottom of the recessed groove defines a first drainage path extending along a side surface of the first housing.

16. The electrical connector assembly of claim 11, wherein the second housing includes a mating block disposed on a front side of the second housing and inserted into the mating opening and a rear end wall disposed on a rear side of the second housing.

17. The electrical connector of claim 16, wherein the mating block includes a flat surface disposed in a receiving cavity of the first housing and a second inclined surface extending from the flat surface toward the rear side and an inside of the second housing.

18. The electrical connector of claim 17, wherein the second drainage structure includes the rear end wall, the second inclined surface of the mating block, and a stop wall recessed between the mating block and the rear end wall.

19. The electrical connector of claim 18, wherein the stop wall forms the second concave region.

20. The electrical connector of claim 19, wherein the stop wall defines a second drainage path in the second drainage structure extending from an upper surface of the second housing and toward a lower surface of the second housing.

* * * * *